US007877914B2

(12) United States Patent
Taylor et al.

(10) Patent No.: US 7,877,914 B2
(45) Date of Patent: Feb. 1, 2011

(54) RETRACTABLE BANNER STANDS WITH COOPERATING BANNERS

(75) Inventors: Ian Taylor, Inver Grove Heights, MN (US); Scott Parizek, Lakeville, MN (US); Mark A. Fritsche, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 234 days.

(21) Appl. No.: 12/329,074

(22) Filed: Dec. 5, 2008

(65) Prior Publication Data

US 2010/0139135 A1 Jun. 10, 2010

(51) Int. Cl.
*G09F 17/00* (2006.01)

(52) U.S. Cl. ..... 40/603; 40/514

(58) Field of Classification Search ..... 40/603, 40/514, 610; 160/120, 121.1
See application file for complete search history.

(56) References Cited

U.S. PATENT DOCUMENTS

| | | | | |
|---|---|---|---|---|
| 4,658,560 | A | 4/1987 | Beaulieu | |
| 6,199,504 | B1 * | 3/2001 | Freeman | 116/63 C |
| 6,332,284 | B1 * | 12/2001 | Tafforeau | 40/603 |
| D468,362 | S | 1/2003 | Zarelius | |
| 6,571,496 | B2 | 6/2003 | Zarelius | |
| 6,829,869 | B1 | 12/2004 | Savoie | |
| 6,836,988 | B2 * | 1/2005 | Zarelius | 40/610 |
| D508,344 | S | 8/2005 | Hwang | |
| 6,951,283 | B2 | 10/2005 | Savoie | |
| 7,024,834 | B2 | 4/2006 | Gimpel | |
| 7,237,350 | B1 * | 7/2007 | Zarelius | 40/610 |
| 7,337,567 | B2 | 3/2008 | Fritsche | |

(Continued)

FOREIGN PATENT DOCUMENTS

| | | |
|---|---|---|
| WO | WO 00/47508 | 8/2000 |

(Continued)

OTHER PUBLICATIONS

Admitted prior art, 1 page, prior to Nov. 12, 2007.

(Continued)

*Primary Examiner*—Gary C Hoge
(74) *Attorney, Agent, or Firm*—Patterson Thuente Christensen Pedersen, P.A.

(57) ABSTRACT

A display comprising a retractable banner stand assembly has a base with a pair of banners extendable therefrom, each banner having a forward surface and a rearward surface. When extended, the banners are arranged in a spaced back face to front face visually overlapping relationship with each banner having graphics on the forward sides of the banner. A forward banner having a different shape than a rearward banner whereby significant portions of the rearward banner may be viewed from directly in front of the banner stand assembly. The precise portion of the rearward banner viewable being dependent upon the viewing angle in front of the display. The base including a housing with each banner being retractable into said housing. In a preferred embodiment the graphics will be aesthetically complementary from the forward banner to the rearward banner; for example, a portion of the graphics on one banner may continue on another banner. An object partially portrayed on one screen can be continued on another screen as a different "depth" or distance from the viewer and may be a different color, shading, or size.

19 Claims, 9 Drawing Sheets

U.S. PATENT DOCUMENTS

| | | | | |
|---|---|---|---|---|
| 2002/0050083 | A1 | 5/2002 | Zarelius | |
| 2009/0183408 | A1 * | 7/2009 | Dicke | 40/610 |

FOREIGN PATENT DOCUMENTS

| | | |
|---|---|---|
| WO | WO 01/35381 | 5/2001 |
| WO | WO 01/91092 | 11/2001 |

OTHER PUBLICATIONS

File History for U.S. Appl. No. 29/327,754, filed Nov. 12, 2008, Inventors: Taylor et al.

File History for U.S. Appl. No. 29/327,755, filed Nov. 12, 2008, Inventors: Taylor et al.

File History for U.S. Appl. No. 29/327,756, filed Nov. 12, 2008, Inventors: Taylor et al.

File History for U.S. Appl. No. 29/327,758, filed Nov. 12, 2008, Inventors: Taylor et al.

File History for U.S. Appl. No. 29/332,957, filed Feb. 27, 2009, Inventors: Taylor et al.

* cited by examiner

RETRACTABLE BANNER STANDS WITH COOPERATING BANNERS

FIELD OF THE INVENTION

This invention relates to free standing and readily erectable graphic displays such as those used for trade shows. More particularly, this invention relates to retractable banner stands.

BACKGROUND OF THE INVENTION

Portable displays for trade shows are typically collapsible structures that can be easily transported, easily erected, and easily collapsed. Such displays can also divide space and support visual graphical displays for viewing by attendees. One common structure for use at trade shows utilizes a network of support rods that expand into a volumetrically substantial three-dimensional space. Such expanded structures are then covered with sheet material capable of supporting graphics on the material. Such structures typically have a curved foot print providing an attractive smooth curved surface for the graphics. The curved footprint effective provides stability and a visually impressive three dimensional presence. See U.S. Pat. No. 4,658,560 assigned to Skyline Displays, Inc., the owner of the instant application. Although such displays are easily assembled by non specialized users, there are several steps involved, notably erecting the framework and applying the covering and graphics to the framework.

Other not-so-portable tradeshow displays may be constructed of rigid structural members that use fasteners to connect such members into three dimensional structures including back walls. Such three dimensional structures can include rectangular frameworks that can create "windows" for suspending display banners. See for example U.S. Pat. No. D508,344 S owned by the owner of the instant invention. These allow graphic screens or banners to be prominently displayed and can be staggered and layered to form visually interesting and varied displays. A disadvantage of such displays is the assembly time and bulky storage and transportation requirements as well as the expense.

An alternative very portable collapsible display are retractable banner stands. These stands are widely used in reception areas, trade shows, museums, art exhibits, academic and research society meetings, advertising displays, and other areas in which visual information is temporarily displayed. A display screen or banner is extended upwardly from a floor based housing and a post extending from the housing is used to maintain the display banner extended and upright. Such banner stands can be seen in U.S. Pat. Nos. 6,571,496, D468,362, U.S. Patent Application Publication 2002/0050083, and PCT Application Nos. WO 01/91092, WO 01/35381, and WO 00/47508, which are all directed to various aspects of retractable banner stands. These applications and publications are incorporated by reference herein in illustrating conventional retractable banner stand mechanisms and components. Retractable banner stands are perhaps the easiest of any collapsible display to erect and take down. Such stands provide the advantages of very quick set-up as well as protection and storage of the graphic display banner in the housing when the display is not in use. The banners on retractable banner stands are conventionally rectangular and are dictated by the size of the housing or more specifically the size of the core in the housing on which the banner is wound during retraction.

The flexible sheet material of banners for retractable banner stands have graphics disposed thereon, typically on a single side. Where it is desireable to view the display from both sides of a banner stand, it is known to connect two banner stands, each with the same size banners, together so that the banners with the graphics side facing outwardly. This can be accomplished by simply connecting two housings together and using a single post for supporting both banners. Other banner stands are known that utilize a single housing that contains two cores with the display banners withdrawable from two separate slots.

In order to give the retractable banner stands more coverage; such may be arranged in side to side alignment and be connected. When arranged in this manner, the series creates a multi-faceted display, each facet may contain a portion of an overall display. Typically banner stands have a singular post centered between the housing ends and extending behind the erected banner and connecting to a horizontal member that supports the top edge of the banner. Certain banner stands with curvature means can also provide a three dimensional aspect as well. See U.S. Pat. No. 7,337,567, incorporated by reference herein. Variations in banner configurations have been limited by conventional rectangular configuration of the banners rolled on the cores.

It is known to couple two banner stands back side to back side such that the graphics are viewable from opposite sides of the coupled banner stands. A single post may be utilized to support both banners. It is also known to have two banners on two different cores extend from a single housing unit with a post positionable in the middle of the housing for supporting both banners.

Thus although there has been variety added to retractable banner stands by adding additional banners and positioning or curving the banners, there has been an absence of innovation directed towards any shapes other than rectangular, of the banners and an absence of innovation directed toward overlapping banner configurations. This is understandable in that any shapes other than rectangular would seemingly present winding and tangling issues when retracted into the housings as well as erected displays that are not taut and wrinkle or fold free.

It would be advantageous to provide additional interesting banner configurations in a retractable banner stand with variations in shapes and overlapping arrangements.

SUMMARY OF THE INVENTION

In certain embodiments, a display comprising a retractable banner stand assembly has a base with a pair of banners extendable therefrom, each banner having a forward surface and a rearward surface. When extended, the banners are arranged in a spaced back face to front face visually overlapping relationship with each banner having graphics on the forward sides of the banner. A first or forward banner having a different shape than the second or rearward banner whereby significant portions of the rearward banner may be viewed from directly in front of the banner stand assembly. The precise portion of the rearward banner viewable being dependent upon the viewing angle in front of the display. The base including a housing with each banner being retractable into said housing. The banners being suspendable from a framework such as a vertical post extending from the base for maintaining the banners in an extended upright display configuration.

In a preferred embodiment the graphics will be aesthetically complementary from the forward banner to the rearward banner; for example, a portion of the graphics on one banner may continue on another banner. An object partially portrayed on one screen can be continued on another screen as a different "depth" or distance from the viewer and may be a different color, shading, or size. In preferred embodiments, the front banner having a plurality of edge profiles extending from the top of the banner to the bottom, that are different than the other banner.

In certain embodiments, the two side edges of each of the banners and being concave in shape, or at least not having any convex edge portions, whereby the banner remains taught when suspended and rolls readily and uniformly without binding and tangling. In certain embodiments each of the embodiments has a central line of symmetry with each side of the banner being a mirror image in shape to the opposite side.

In certain embodiments, the banners of a retractable banner stand having a shape of one of the following: hourglass, trapezoidal, or apertured. Such banners may be placed spaced from a rearward banner that has a contrasting shape, for example rectangular.

In certain embodiments, the edges of the forward banner being either straight from the top of the banner to the bottom, or having straight edge segments with no outward protruding edge portions intermediate the top of the banner and the bottom of the banner, or being curved from the top of the banner to the bottom with no outward protruding edge portions, or having a combination of curved edge segments and straight edge segments with no outwardly projecting edge portions.

In certain embodiments, the front banner will be smaller in area than the rearward banner. Preferably the surface area of the front banner will be 10 to 70 percent smaller. Alternatively the front surface area will be 20 to 50 percent smaller than the surface area of the rear banner. In a preferred embodiment the surface area of the rearward banner will be at least 16 square feet. An appropriate range of the front surface area of the rearward banner is 14 to 28 square feet. A more appropriate range is 15 to 24 square feet. Optimal effects are believed to be provided with separation of the visually overlapping banners a distance of about 4 to 9 inches. Another appropriate range being 3 to 14 inches. The forward and rearward banners are in a preferred embodiment arranged to be parallel. In other embodiments they may converge near the top portions of the banners or may diverge. In such an instance, where the banners converge or diverge upwardly, the spacing at the vertical midpoint of the banners is preferably from 3 to 8 inches.

An advantage and feature of the invention is that aesthetically interesting and pleasing visual effect is created in a easily erected banner stand whereby the portion of the rearward banner viewable from in front of the display varies directly with the position of the viewer. In preferred embodiments, each of the banners has a vertical and horizontal midpoint and both midpoints are in alignment, in other words a line drawn normally, at a right angle from the plane of the banner, from the midpoint of one banner intersects the midpoint of the other banner.

In preferred embodiments that are symmetrical about a vertical line of symmetry in the banner, during the winding process, the banner stays taut during the entirety of the winding-retraction process and provides a self centering effect. A helical pattern is provided for the trapezoid, hourglass shapes that does not urge the winding either to the left or right.

BRIEF DESCRIPTION OF THE DRAWINGS

FIG. 5 is a side elevational view of the housing of FIG. 4 with the end plate on.

DETAILED DESCRIPTION OF PREFERRED EMBODIMENTS

Figure 1:
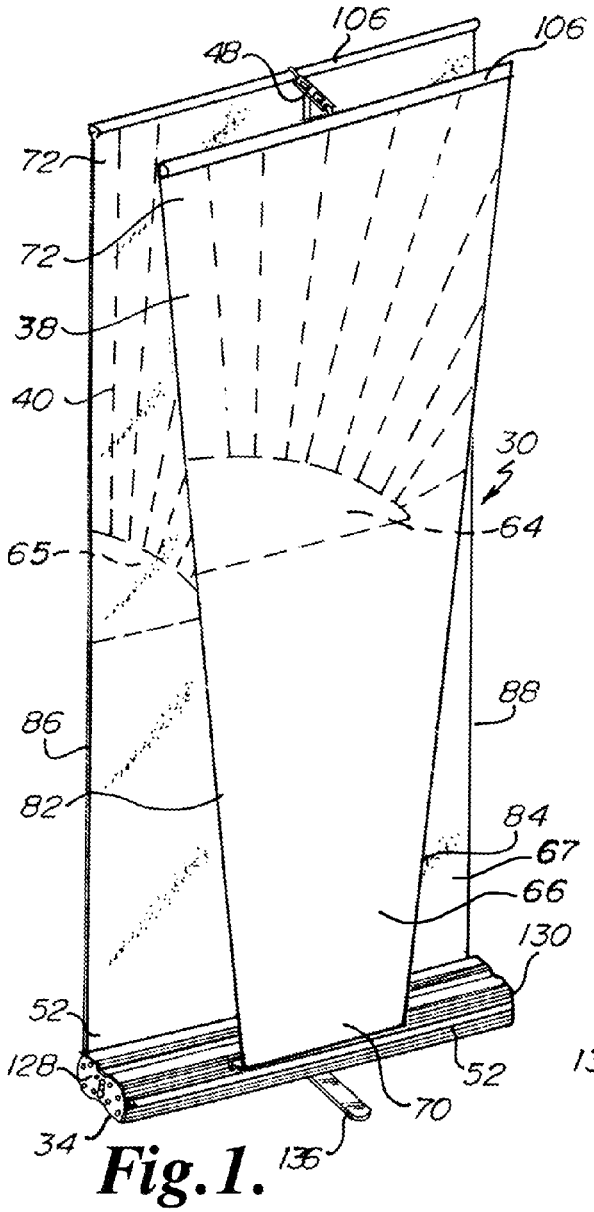
FIG. 1 is a perspective view of a retractable banner stand embodying the invention.
Figure 2:
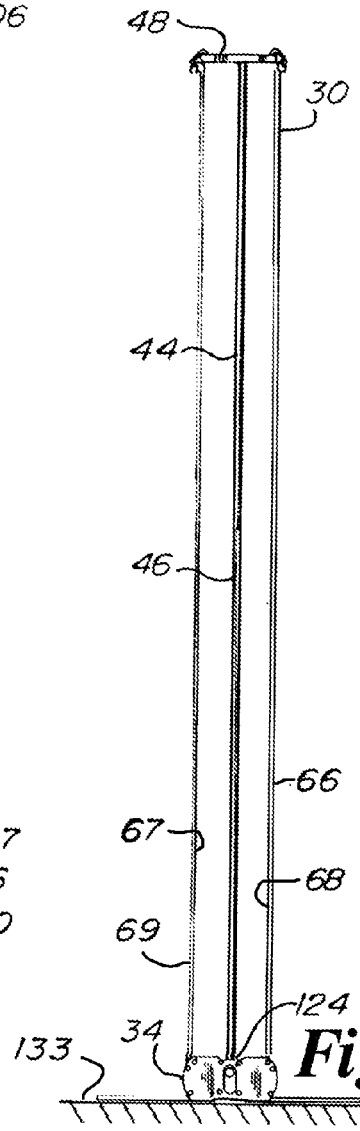
FIG. 2 is a side elevational view of the retractable banner stand of FIG. 1. This is also a side elevational view of the banner stands of FIGS. 6, 7, 8, 9, 10, 11, 12, 13, 14, 15, 16, 17, 18, 19, 20, and 21. The side elevational views from the opposite sides being a mirror image thereof.
Figure 3A:
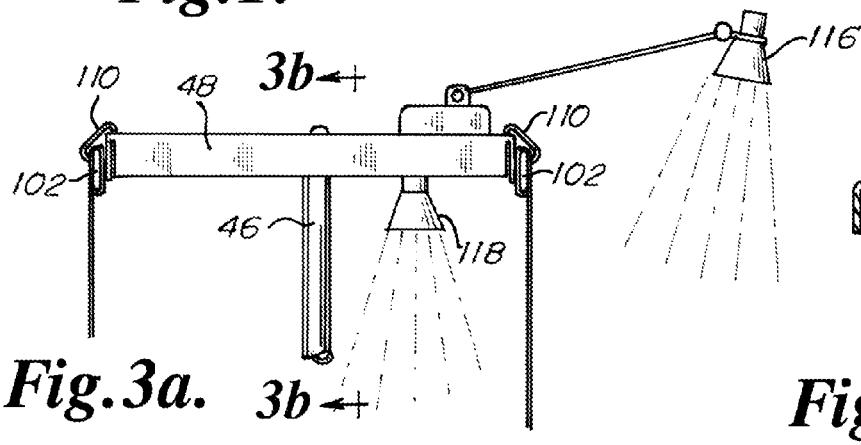
FIG. 3*a* is a detailed side elevational view of connection of the banners to the post assembly in accord with embodiments of the invention.
Figure 3B:
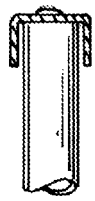
FIG. 3*b* is a cross-section taken at line 3*b*-3*b* of FIG. 3*a*.

Referring to FIGS. 1, 2, and 3*a* retractable banner stand assembly is illustrated and is generally designated with 30. The retractable banner stand assembly principally comprised of a base 34, a pair of banners with one banner, a first banner 38 in front of the other banner, a second banner, 40, and a support framework 44 comprising a support post 46 and an upper bridging member 48. The post 46 extends from the base. The base 34 is comprised of at least one housing 52 containing a pair of cores 56 rotatably secured within the housing. Said rotatable cores have the banners 38, 40 windable thereon. The cores may be in separate distinct housings attached to one another or may be in a single housing with dual core assemblies.

Retractable banner stands are illustrated in U.S. Pat. Nos. 7,337,567, 6,571,496, D468,362, U.S. Patent Publication No. 2002/0050083, and PCT application Nos. WO 01/91092, WO 01/35381, and WO 00/47508 which are incorporated herein by reference and illustrate suitable conventional retractable banner stand mechanisms and components.

The banners as illustrated in FIGS. 1 and 2, are flexible sheet materials such as poplin, textiles, polyplastic, or other sheet material. The banners have graphics 64, 65 thereon on the front surface and front side 66, 67 opposite the rear sides and rear surfaces 68, 69. The forward banner 38 preferably has a surface area which is smaller than the surface area of the rearward banner 40 and has a shape different that the rearward banner whereby the rearward banner is visible directly in front of the display due to the reduced area of the forward banner.

Each banner has a lowermost portion 70 and an uppermost portion 72. The lowermost portion is attached to the core and may be attached directly or through leader connection mechanisms that allow replacement of the banner with a different banner. Each banner has side edges including a left edge 82, left edge portion 83 and a right edge 84 of a front banner and a left edge 86 and a right edge 88 of the rear banner. Each banner has a rigid cross member 102 at the uppermost edge portion 106 of the said rigid cross member provides support for the entire width of the specific banner. The cross member can suitably formed of a strip of metal, plastic, or wood. A connecting member, for example a hook 110 extends from the rigid support member for attachment to the support member 48. The banner top edge portion may be looped around or adhered to the rigid support member.

The support post assembly may support lighting fixtures 116, 118 to provide direct or indirect illumination of the banners. Wiring can be hidden within the vertical post.

As illustrated the support framework specifically the post 46 extends from a socket 124 in the base specifically the housing. Said socket will typically be centrally located intermediate the two banners and intermediate the two ends 128, 130 of the housing. The housing will have floor or horizontal surface engagement members such as feet 136 to provide stable support of the retractable banner stand assembly on a floor 133.

Referring to FIGS. 1, 6, 7, 8, 9, 10, 11, 12, various configurations of the forwardly most banner are illustrated. The front banners 38 have a reduced area from the rearward banner which provide direct visual exposure of the rearward banner from in front of the retractable display assembly. In preferred embodiments the graphics on the front banner will be complimentary to the graphics on the rear banner. Such complimentary nature may be in the form of specific objects or designs carrying over from the front banner to the rear banner. Additionally the front banner may display visual effects may be provided such as having the front banner be partially transparent allowing the rear banner to be visually seen through the front banner.

The different shapes have the commonality that the edge portions on both the left edge, the right edge, and the interior edges all have either a straight edge portion from the top uppermost portion of the banner to the lowermost portion of the banner or have a concave shape extending the entirety of the length from the uppermost portion of the banner to the lowermost portion of the banner on the edge portions. Alternatively it may be stated that there are no protruding edge portions creating a convex shape on any of the edge portions of the banner. Such limitations in the configuration of the banner have been found to allow excellent wind-up characteristics and extension characteristics as well as allowing the banner to stay taut when in the extended position.

Figure 3C:
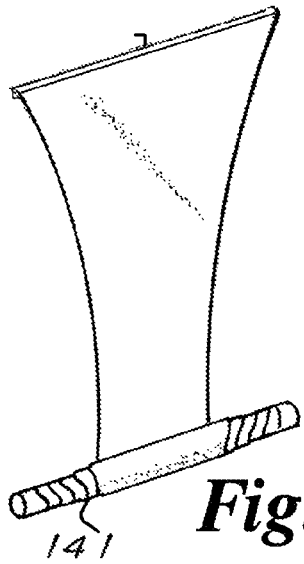
FIG. 3*c* is an elevational view of a curved banner partially wound onto a core illustrating the symmetrical and helical winding pattern.
Figure 4:
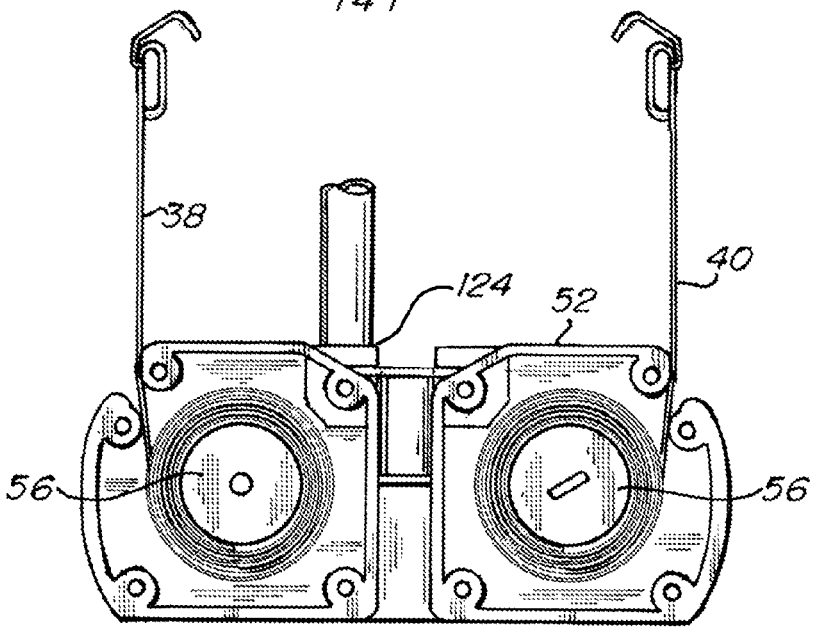
FIG. 4 is side elevational view of the housing of a base illustrating the cores therein.
Figure 5:
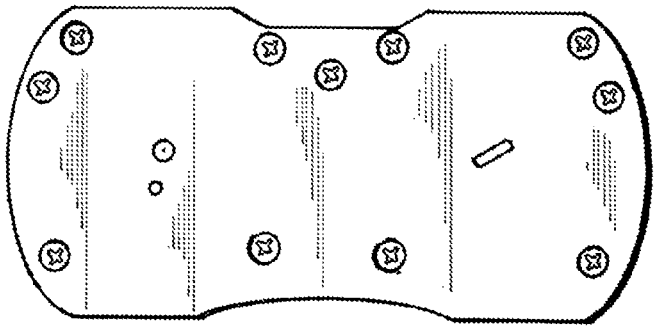
Figure 6:
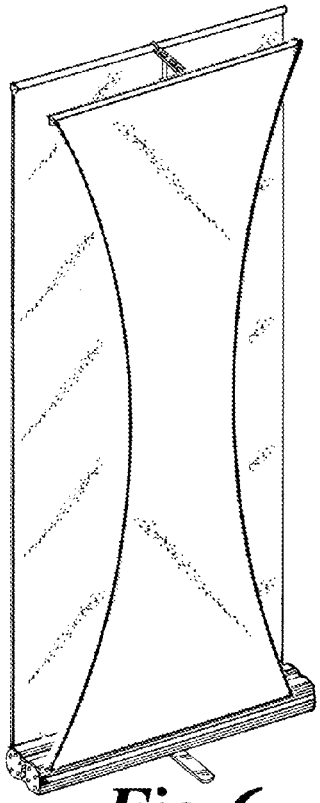
FIG. 6 is a perspective view of an embodiment of the invention. The view from the adjacent front corner being a mirror image thereof.
Figure 7:
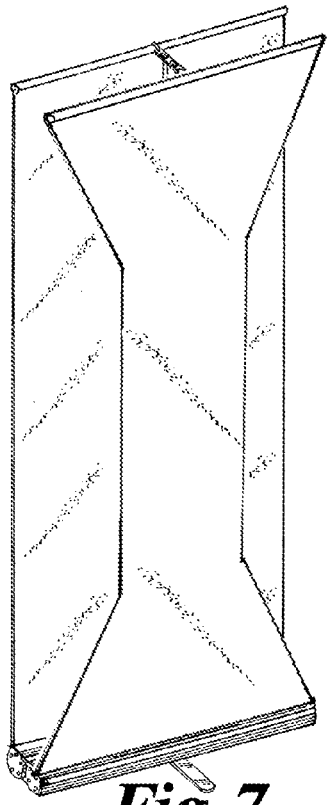
FIG. 7 is a perspective view of the invention. The view from the adjacent front corner being a mirror image thereof.
Figure 8:
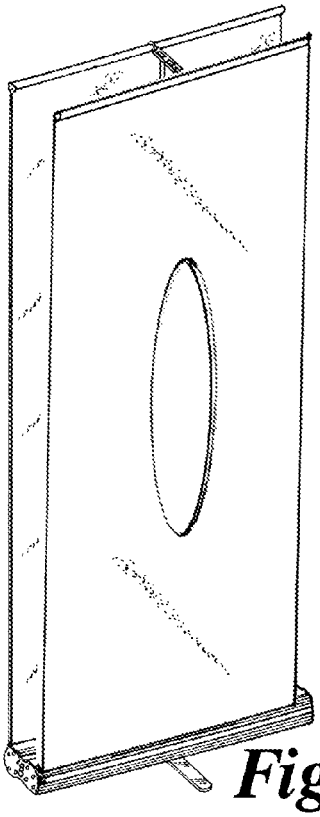
FIG. 8 is a perspective view of an embodiment of the invention. The view from the adjacent front corner being a mirror image thereof.
Figure 9:
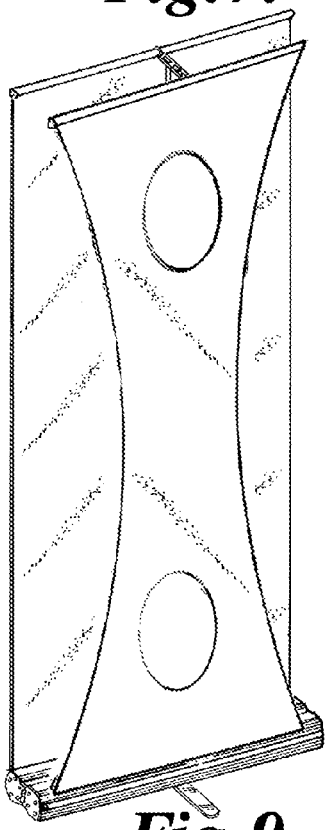
FIG. 9 is a perspective view of an embodiment of the invention. The view from the adjacent front corner being a mirror image thereof.
Figure 10:
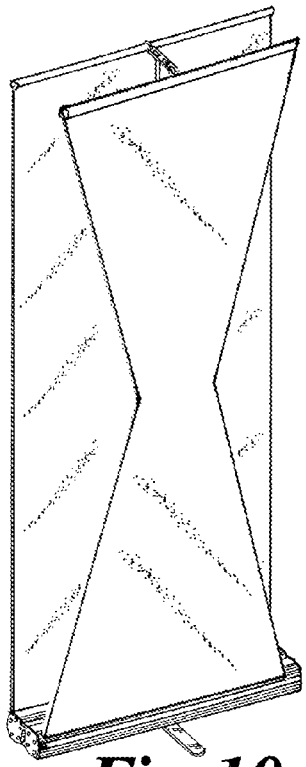
FIG. 10 is a perspective view of an embodiment of the invention. The view from the adjacent front corner being a mirror image thereof.
Figure 11:
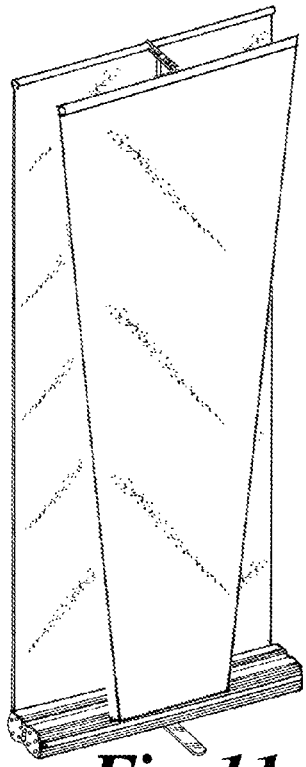
FIG. 11 is a perspective view of an embodiment of the invention. The view from the adjacent front corner being a mirror image thereof.
Figure 12:
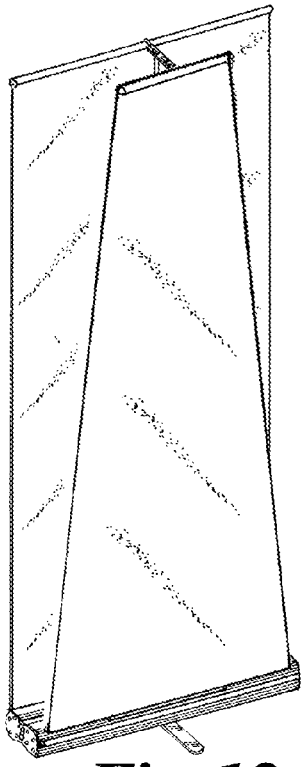
FIG. 12 is a perspective view of an embodiment of the invention. The view from the adjacent front corner being a mirror image thereof.
Figure 13:
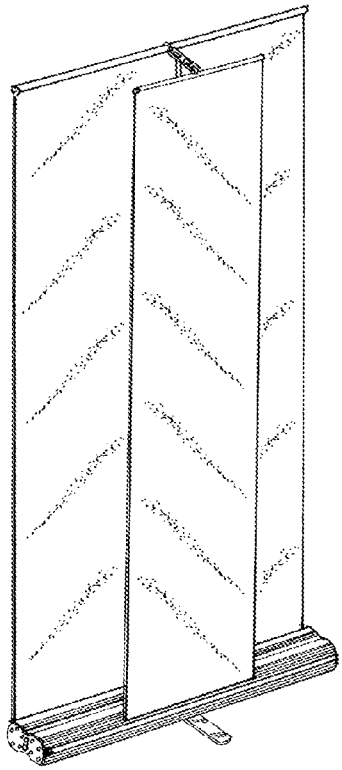
FIG. 13 is a perspective view of an embodiment of the invention. The view from the adjacent front corner being a mirror image thereof.
Figure 14:
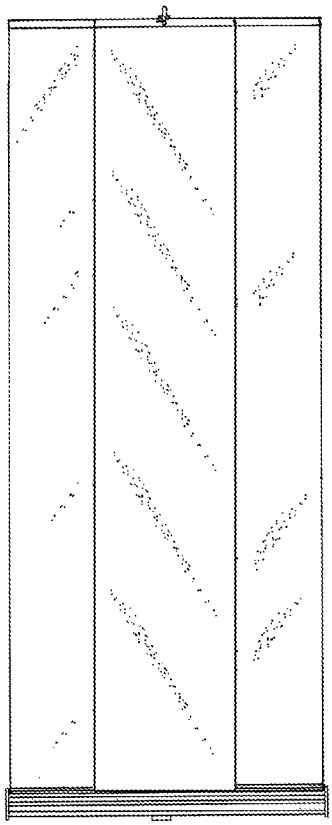
FIG. 14 is a front elevational view of the retractable banner stand of FIG. 13.
Figure 15:
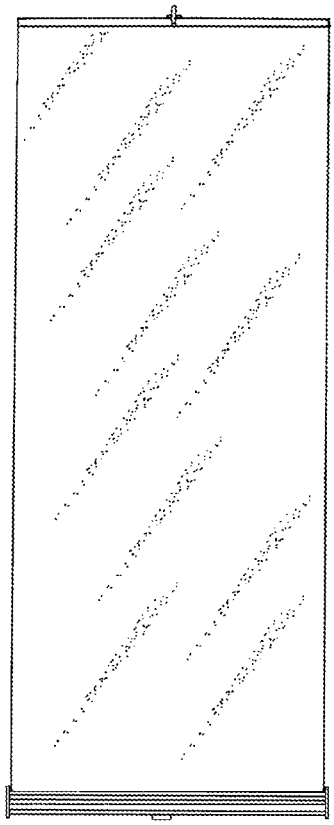
FIG. 15 is a rear elevational view of the banner stands of FIGS. 1, 2, 6, 7, 8, 9, 10, 11, 12 and 13.
Figure 16:
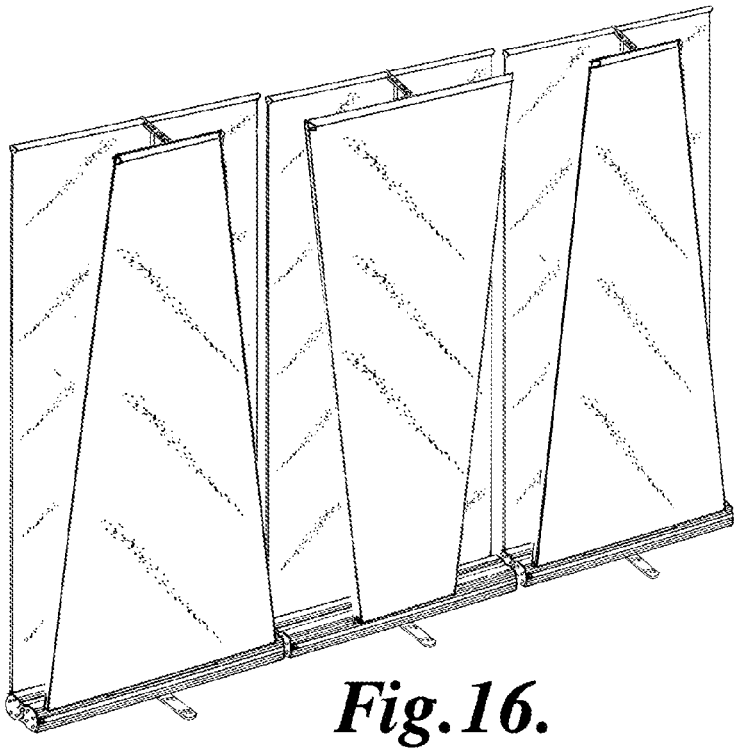
FIG. 16 is a front perspective view of an embodiment of the invention. The perspective view from the adjacent front corner being a mirror image thereto.
Figure 17:
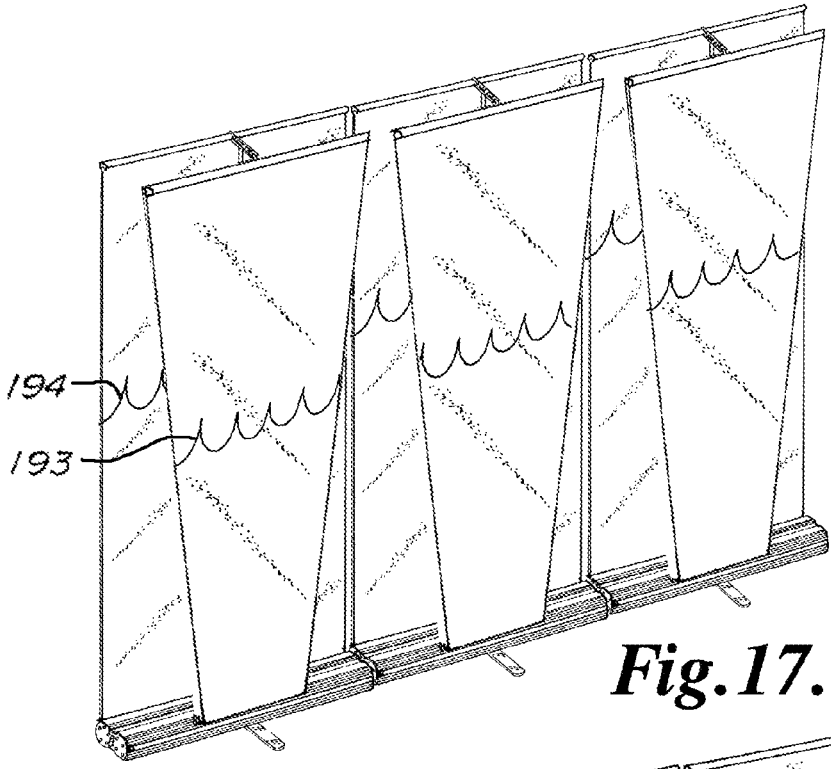
FIG. 17 is a front perspective view of an embodiment of the invention. The perspective view from the adjacent front corner being a mirror image thereof.
Figure 18:
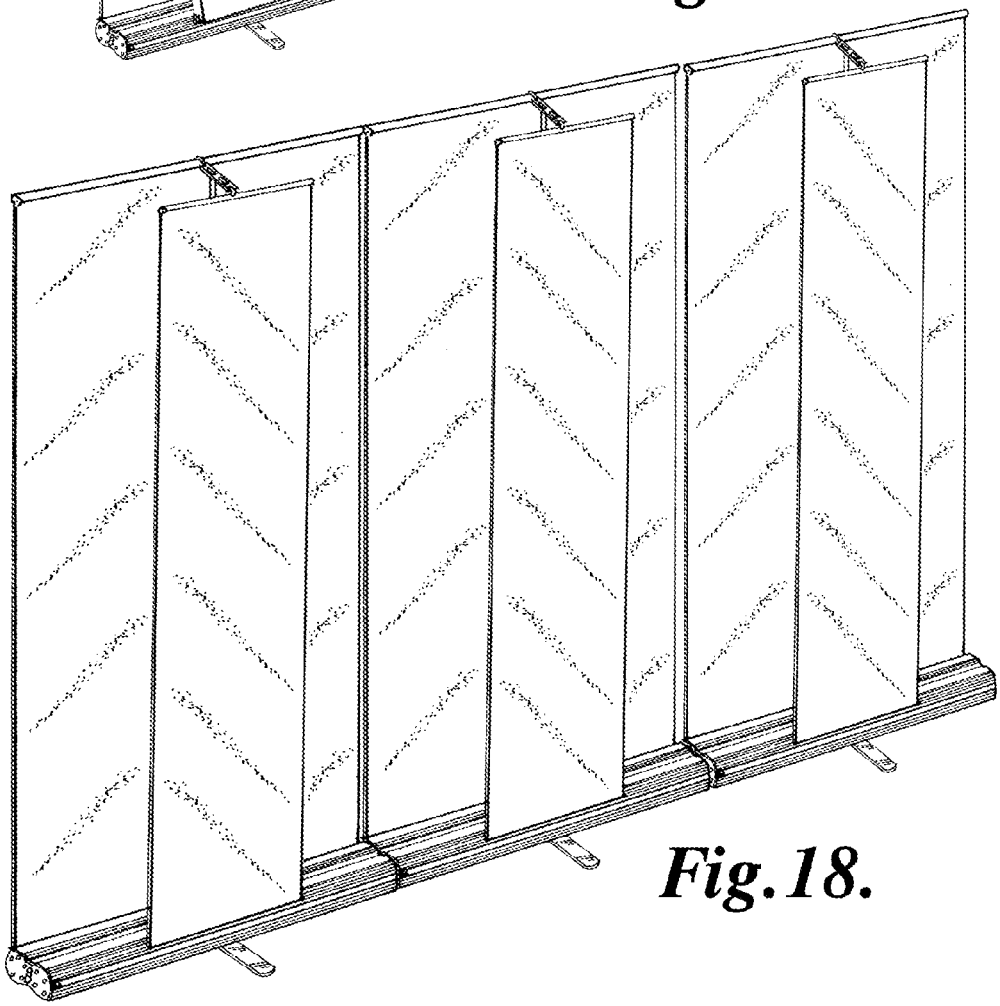
FIG. 18 is a front perspective view of an embodiment of the invention. The perspective view from the adjacent front corner being a mirror image thereof.
Figure 19:
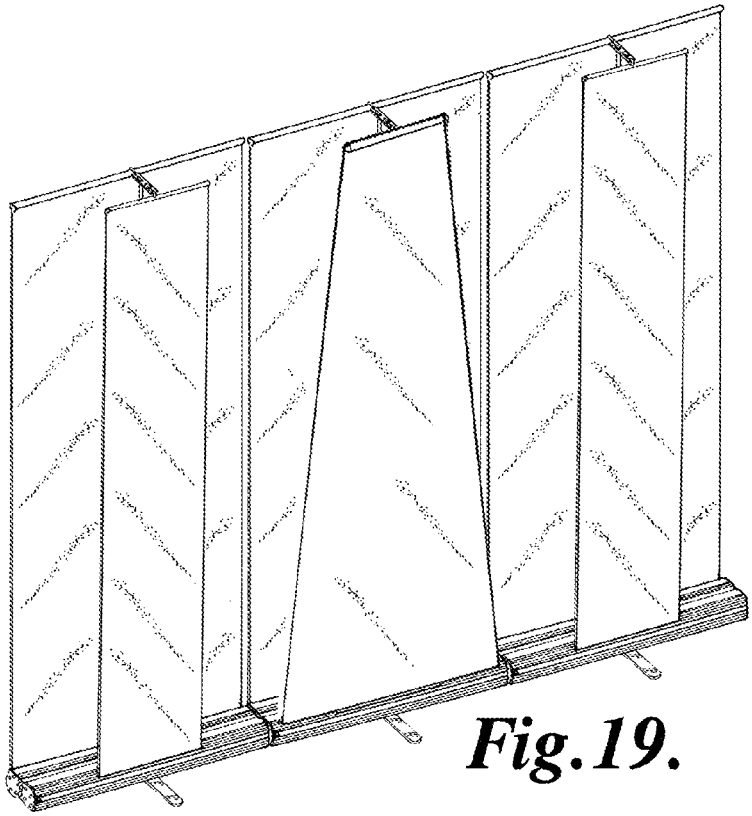
FIG. 19 is a front perspective view of an embodiment of the invention. The perspective view from the adjacent front corner being a mirror image thereof.
Figure 20:
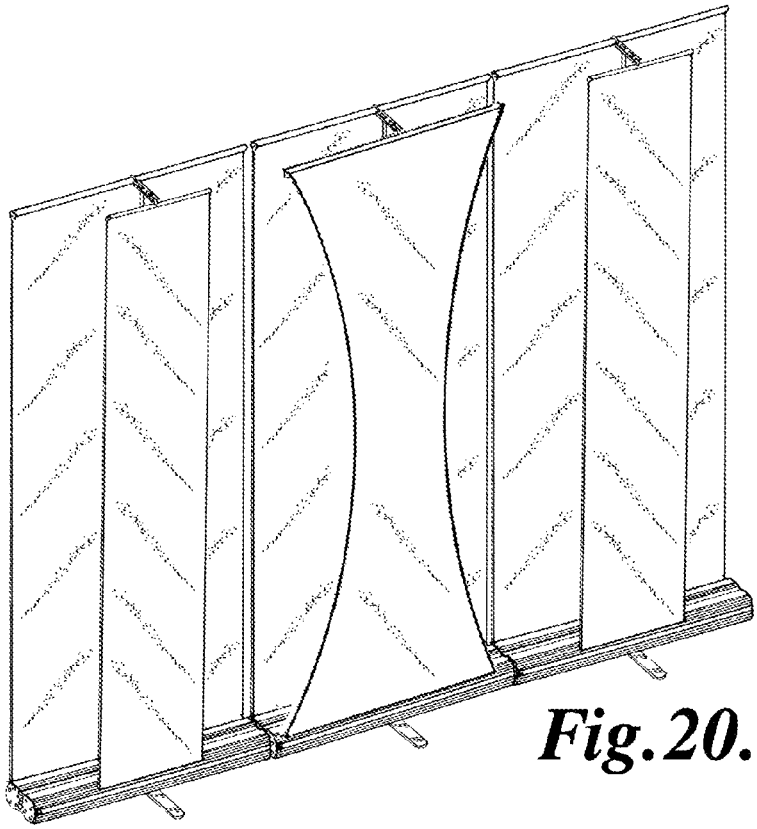
FIG. 20 is a front perspective view of an embodiment of the invention. The perspective view from the adjacent front corner being a mirror image thereof.
Figure 21:
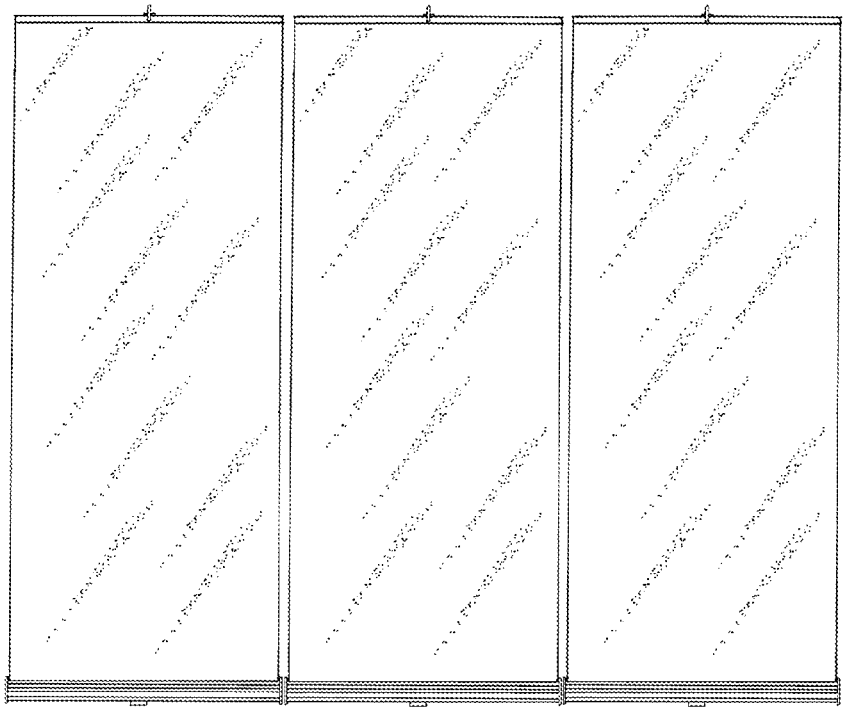
FIG. 21 is a rear elevational view of the embodiments illustrated in FIGS. 16, 17, 18, 19 and 20.
Figure 22:
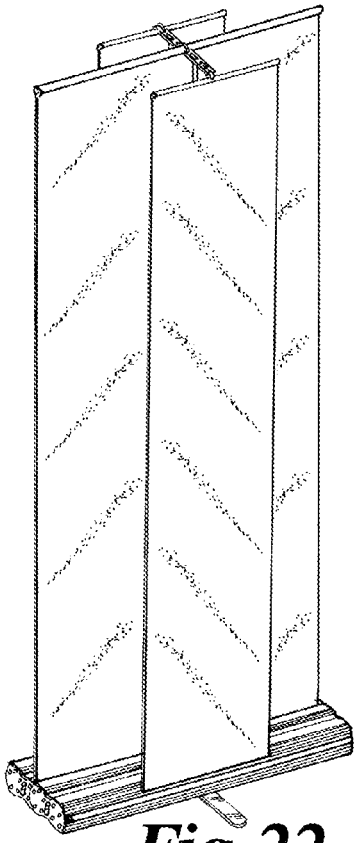
FIG. 22 is a perspective view of an embodiment of the invention. The perspective view from the adjacent front corner being a mirror image thereof.
Figure 23:
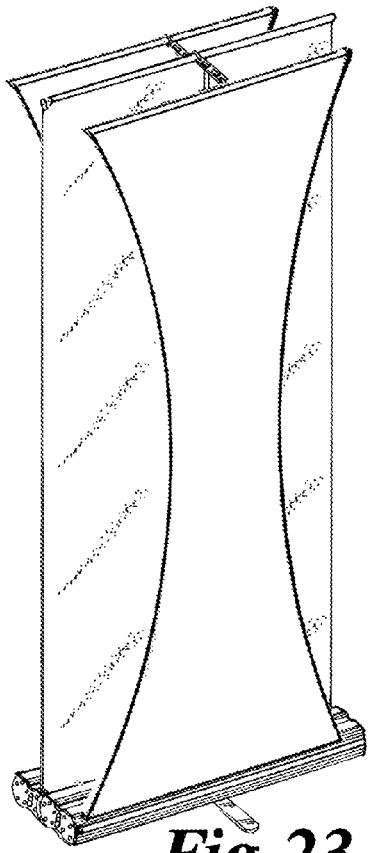
FIG. 23 is a front perspective view of an embodiment of the invention. The perspective view from the adjacent front corner being a mirror image thereof.
Figure 24:
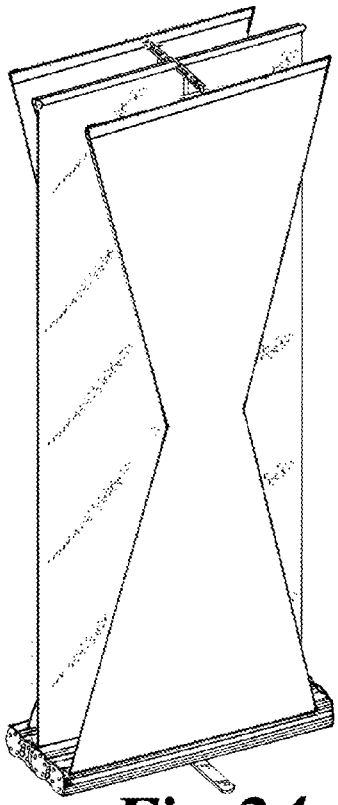
FIG. 24 is a front perspective view of an embodiment of the invention. The perspective view from the adjacent front corner being a mirror image thereof.
Figure 25:
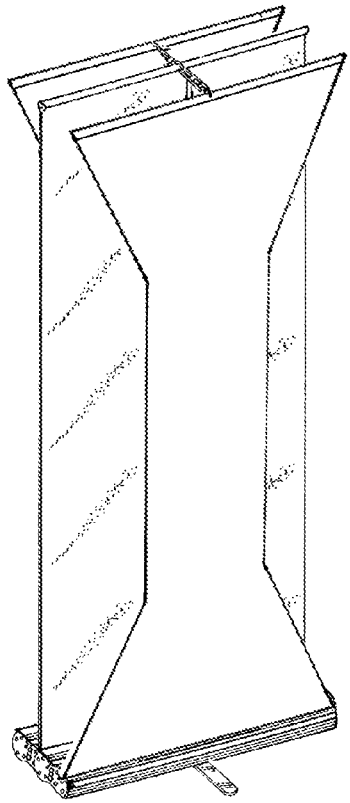
FIG. 25 is a front perspective view of an embodiment of the invention. The perspective view from the adjacent front corner being a mirror image thereof.

Referring to FIG. 3*c*, the two edges may form a helical pattern 141 as the core winds up the banner. During the winding process, due to the lack of any convex or protruding edge portions, the banner stays taut during the entirety of the winding-retraction process and provides a self centering effect. In preferred embodiments, the banner winds in a helical manner on both sides of the core maintaining centering of the wound banner.

Referring to FIGS. 16, 17, 18, 19 and 20, various embodiments of the invention are illustrated utilizing the individual retractable banner stand assemblies as illustrated in the previous figures for joining into a 3-part assembly to provide greater lateral width. The perspective bases or housing can be suitably fastened together with fasteners or magnets. Similarly, the upper edge portions of banners can be secured by way of fasteners or magnets. See U.S. Pat. Nos. 7,337,567 and 6,836,988 for means of connecting adjacent retractable banner stands. Said patents are incorporated herein by reference.

In such banner stands where banners are arranged edge to edge, as illustrated, the graphic images 193 may extend and suitably will extend across all three banner stands forward banner stands and may have a shadow or continuing image 194 on the rearward banners.

Referring to FIGS. 22, 23, 24 and 25 additional embodiments illustrate where three distinct visually overlapping banners 205, 210 and 215 with the outermost banners 205 and 215 having sizes smaller than the intermediate banner 210. The base 220 may be formed of three discrete housings 222 secured together to form a unitary base or a single housing with three cores therein. Support posts may extend from centrally located intermediate the innermost banner and each of the two outer banners.

Figure 26:
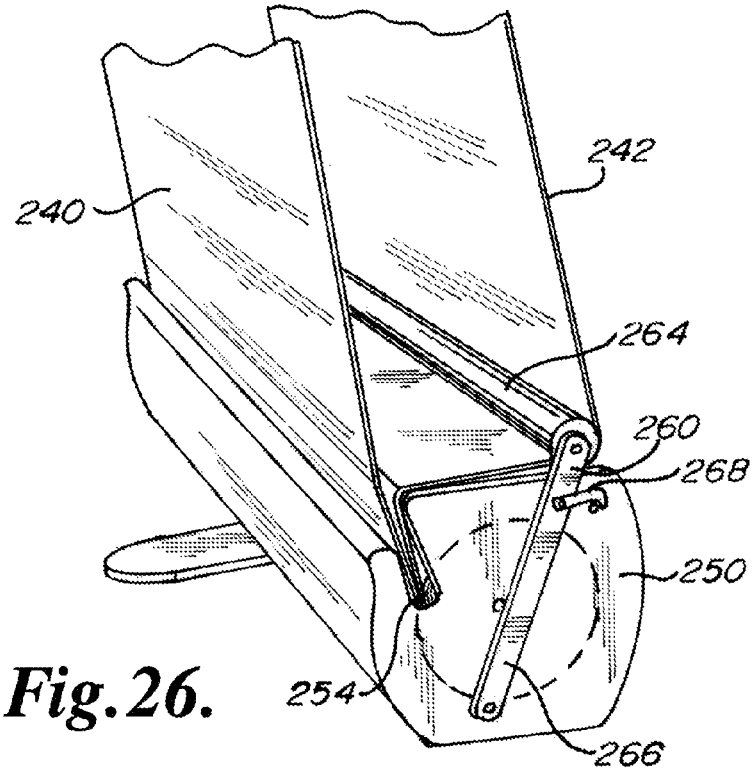
FIG. 26 is a perspective end view of an alternative embodiment of a base where two banners are wound on the same core and contained in a housing.

Referring to FIG. 26 an alternative housing is illustrated where two banners where 240 and 242 extend from a single housing 250 with a single core 254 with both banners wrapped around the core. A separator mechanism 260 may be utilized to provide the spacing of the two banners in such a case the support post must extend upwardly from either the ends of the housing or from behind the rearward banner. The separator mechanism may comprise a roller 264 mounted on a pivoting link 266 with a latch 268.

Further variations are contemplated and to be considered part of the invention herein. The banners may have curvatures about the vertical axis added, either to all the banners or selectively, such as the rearward banners. Such curvature may be provided by mechanisms such as disclosed in U.S. Pat. No. 7,337,567, incorporated by reference herein. In certain cases, the banners need not be symmetrical, for example, the forward banner could have a left edge with a curved concave shape, a half of an hourglass, and the right edge could have a straight vertical shape. Moreover in certain instances, two vertical strips of banner material may be on a single core such that two narrow bars or strips are presented.

The embodiments above are intended to be illustrative and not limiting. Additional embodiments are within the claims. In addition, although the display and banner magnets have been described with reference to particular embodiments, those skilled in the art will recognize that changes can be made in form and detail. Any incorporation by reference of documents above is limited such that is subject matter is incorporated that is contrary to the explicit disclosure herein.

We claim:

1. A retractable banner stand assembly comprising a base for placement on a floor surface or other horizontal surface, at least one upright post extending from the base, a pair of banners with one banner in front of the other banner, the one banner in front having a shape with an area less than the area of the other banner, the one banner in front having two side edges extending lengthwise and not having any convex edge portions, the banners extending upwardly from the base and supported by the upright post and a spacer bar at the top of the post for positioning the banners in a parallel spaced arrangement, the base comprising a housing, a pair of cores and a pair of retracting mechanisms for winding the banners on the cores contained by the housing, the cores fixed in position with respect to one another.

2. The retractable banner stand assembly of claim 1 wherein each banner comprises a horizontal rigid top edge portion extending along a top edge of each banner, the banner stand assembly further comprising a horizontal support member extending between the horizontal rigid edge portions of each banner thereby supporting the banners at an equal elevation.

3. The retractable banner stand assembly of claim 1 wherein the one banner in front of the other has a lengthwise edge profile that provides a concave shape to each side of the banner and the other banner has a rectangular shape.

4. The retractable banner stand assembly of claim 3 wherein banner in front of the other has edge profiles formed of one of straight line segments and curved line segments.

5. The retractable banner stand assembly of claim 1 wherein the one banner in front of the other has a lengthwise profile that tapers from one of the top to the bottom and the bottom to the top.

6. The retractable banner stand assembly of claim 1 wherein the one banner in front of the other has at least one opening in the banner whereby the other banner is visible through said opening.

7. The retractable banner stand assembly of claim 1, wherein the post is positioned intermediate the two banners.

8. The retractable banner stand assembly of claim 1, further comprising an illumination source at the top of the post to provide illumination between the pair of banners.

9. The retractable banner stand assembly of claim 1 wherein the base comprises two housings, each housing comprising one of the two cores and one of the two retracting mechanisms, the two housings separable from one another.

10. The retractable banner stand assembly of claim 1, wherein each banner is connected to the core by way of a leader portion with horizontal sliding connector for removing and replacing the banner.

11. A retractable banner stand assembly comprising a base, a support framework extending upwardly from the base, a pair of banners with one banner in front of the other banner, the banners extending upwardly from the base and supported by the support framework, the one banner having a shape different that the other with a pair of side edge portions of the one banner displaced inwardly with respect to the other banner, each of the two banners presenting a graphic image with at least one object of the image extending to both banners, the support framework separable from the housing and the pair of banners retractable into the base into a transport configuration.

12. A retractable banner stand assembly comprising a base for placement on a floor or other horizontal surface, a support framework extending upwardly from the base, a pair of banners with one banner in front of the other banner, the banners extending upwardly from the base and supported by the support framework, the one banner having a shape different that the other with a pair of side edge portions of the one banner displaced inwardly with respect to the other banner, each having graphics thereon, the graphics of one aesthetically complementary to the other, the support framework separable from the housing and the pair of banners retractable into the base into a transport configuration.

13. The retractable banner stand assembly of claim 12 further comprising at least one additional base, a pair of banners with one banner in front of the other banner, the banners extending upwardly from the base, the one banner having a shape different that the other with a pair of side edge portions of the one banner displaced inwardly with respect to the other banner, each having graphics thereon, the graphics of one aesthetically complementary to the other, the support framework separable from the housing and the pair of banners retractable into the base into a transport configuration, and wherein each of the bases may be aligned and connected in an end to end arrangement.

14. A retractable banner stand assembly comprising a base for placement on a floor or other horizontal surface, the base configured as a housing with an open interior containing at least one core, the housing having an aperture for receiving a post, a post placeable into the aperture for extending upwardly from the housing for supporting the a pair of banners extendable from and retractable into the interior of said housing through at least one slot, the pair of banners positioned to be arranged in an extended display position with one banner in front of the other banner, the one banner in front having a shape reduced in area from the other banner whereby the other banner is partially viewable from a viewing position displace from and directly in front of the one banner.

15. The retractable banner stand of claim 14 wherein each of the pair of banners is attached to a single core and wherein both banners extend through a single slot and wherein the banner stand further comprises a mechanism for separating the banners from one another adjacent the slot when the banners are in a display configuration.

16. A retractable banner stand assembly comprising a base for placement on a floor surface or other horizontal surface, the base comprising a pair of housings, each housing having an open interior and a slot open upwardly, each housing having a rotatable core mounted therein and connecting to a retracting mechanism, and a flexible sheet banner wound onto the rotatable core, the pair of housings attached to one another whereby when the banners are extended from the housings, they extend upwardly and are separated from one another, the banner stand assembly further comprising a post extendable from the base for supporting the banners when they are extended from the housings, the banners each having a shape different from the other and each having graphics thereon.

17. A method of forming a layered banner stand with contrasting and complimentary banners, the method comprising the steps of:

providing a plurality of individual retractable banners, with at least two of the banners having different edge shapes and where at least one banner having edge portions laterally inset a distance more than another of said banners;

Assembling the plurality of individual banners in an aligned horizontal stacked arrangement whereby when the banners are extended the banners are visually overlapping and face to face with one another.

18. The method of claim 17 wherein one of the banners smaller in surface area than another one and said one of the banners is shaped as one of the following: trapezoidal, hourglass, and apertured.

19. A banner stand comprising a base, a pair of banners extending from a pair of cores in the base, the banners windable on said cores, a post extending upwardly from the base and securing the banners in an upright extended position, one in front of the other and spaced apart, the one in front of the other having a surface area smaller than the other and having edge portions symmetrical about a line of symmetry.

* * * * *